US005382178A

United States Patent [19]

Laloum et al.

[11] Patent Number: 5,382,178

[45] Date of Patent: Jan. 17, 1995

[54] PROCESS AND APPARATUS FOR THE TERMINATION OF ELECTRIC CABLES INSTALLED IN A BUILDING FOR SUBSEQUENT CONNECTION

[75] Inventors: Laurent Laloum, Avignon; Didier Lecomte, Cavaillon, both of France

[73] Assignee: Interco S.A., Cavillon, France

[21] Appl. No.: 34,804

[22] Filed: Mar. 19, 1993

[30] Foreign Application Priority Data

Mar. 30, 1992 [FR] France ..... 92 03810

[51] Int. Cl.[6] ..... H01R 13/58

[52] U.S. Cl. ..... 439/460; 439/407

[58] Field of Search ..... 439/436–441, 439/400, 401, 407, 460

[56] References Cited

U.S. PATENT DOCUMENTS 4,160,575 7/1979 Schraut .

5,073,126 12/1991 Kikuchi et al. ..... 439/460 X

FOREIGN PATENT DOCUMENTS 447184 3/1991 European Pat. Off. .

447869 3/1991 European Pat. Off. .

8804121 3/1988 Germany .

*Primary Examiner*—Eugene F. Desmond

*Attorney, Agent, or Firm*—Sughrue, Mion, Zinn, Macpeak & Seas

[57] ABSTRACT

The process for the termination of electric cables (2) makes it possible, during the installation of the electric structure of a building, to prepare the final connection of each cable (2) by any random operator. Use is made of standardized cable termination means for provisionally storing the cable ends. The apparatus essentially comprises a block (1) within which is inserted, for each cable (2), a locking part (3) having a flexible tongue (5). The introduction of a cable (2) into its recess (7) is definitive as a result of the locking action of the tongue (5). The final connection takes place by means of a connecting hole (8) traversing the recess (7). It is therefore possible to prepare the connection of numerous cables with numerous electrical equipments to be supplied.

4 Claims, 2 Drawing Sheets

PROCESS AND APPARATUS FOR THE TERMINATION OF ELECTRIC CABLES INSTALLED IN A BUILDING FOR SUBSEQUENT CONNECTION

DESCRIPTION

1. Field of the Invention

The invention relates to the construction field and in particular the laying of electric cables for transmitting data (video, data processing, telephone, etc.) for different equipments to be installed within the buildings. The use of such an apparatus takes place during the laying of electric cables in the building.

2. Prior Art and Set Problem

During the construction of buildings, it is indispensable to install within the walls, ceilings and floors, the electrical infrastructure necessary for the electric power supply and data transfer of all equipments to be installed within said building. In this way, a large number of cables of different sizes are introduced into ducts, which are themselves located within the building structure. It is necessary to provide an easy and unsophisticated subsequent access to said various electric cables for the connection of the various installations to be supplied. Thus, these electric cables or wires project by a few dozen centimetres from the various sheaths and ducts. During subsequent installation of equipments in the rooms, said cables are connected to fixed connections in the walls, such as wall sockets or connecting panels. These final locations are chosen as a function of the internal configuration of the rooms and the different equipments to be installed there.

It is therefore known to use panels, preferably wall panels, into which is introduced the end of electric cables bared or stripped to a greater or lesser extent by a minimum length of approximately 50 mm. This involves a protective efficiency loss with respect to radio frequencies. The connection to the rear of a panel often takes place on a contact strip or bar to be bared. It takes place wire by wire using a special tool.

In the case of wall sockets or outlets, connection takes place following a preparation of the cable end. The installation of each wire in its recess must then be performed, as well as a crimping operation, either wire by wire, or on an overall basis, which is of long duration with respect to the final cabling. In addition, the use and definition of a wall socket can only be defined at the last moment, when the electrical communication needs of the room to be fitted out are known. This raises a problem of a time lag between the choice of the cable and its connection in a building and the end of the work. It is also necessary to reduce the final installation times, i.e. during the fitting out of rooms, in spite of the fact that the arrangement is not known at the time of construction.

The problem of the invention is to obviate these disadvantages by proposing a different concept for the connection of the electric cables of the building to the installations to be supplied therein.

SUMMARY OF THE INVENTION

To this end, the first main object of the invention is a process for the installation of electric cables in a building during the construction of the latter, characterized in that, in order to permit the subsequent connection of cables to equipments which they are required to supply once the construction of the building is ended, it consists of using standardized cable termination means at the end of each of the cables, in order to provisionally store said cable ends in a clearly defined and identifiable manner, so as to permit the subsequent connection of each of the cables to various installations, sockets or connections of a standardized nature corresponding to the termination means.

The second main object of the invention is an apparatus for the termination of electric cables installed in a building and for subsequent connection to the different equipments to be supplied. It mainly comprises a block having at least one cavity traversed by a recess for a wire, said recess being traversed by a connecting recess and a locking means located in the cavity and locking the corresponding wire within the apparatus.

According to the main embodiment of the apparatus according to the invention the locking means are constituted by a locking part having a flexible and oblique clip, oriented towards the inside of the recess and whose end leads into the volume of the cavity occupied by the wire recess, so as to be able to exert a pressure on the latter and maintain it in place in order to prevent any wire withdrawal operation. Preferably, the locking part and block are made from a plastics material.

In a preferred application, a printed circuit can be fixed to the block by means of split studs. In this case, it is preferable to insert an intermediate support between the block and the printed circuit.

It is also of interest to provide a box within which can be inserted one or more assemblies constituted by the block and the locking parts. Everything can be supported by a panel able to receive at least one box. The box can comprise a base receiving the latter and transforming the same into a wall socket.

LIST OF DRAWINGS

The invention is described in greater detail hereinafter relative to non-limitative embodiments and the attached drawings, wherein show:

FIG. 1 the apparatus according to the invention in its simplest construction.

FIG. 2 in section, the construction of the invention on a panel connected to a printed circuit.

DETAILED DESCRIPTION OF AN EMBODIMENT OF THE INVENTION

Figure 1:
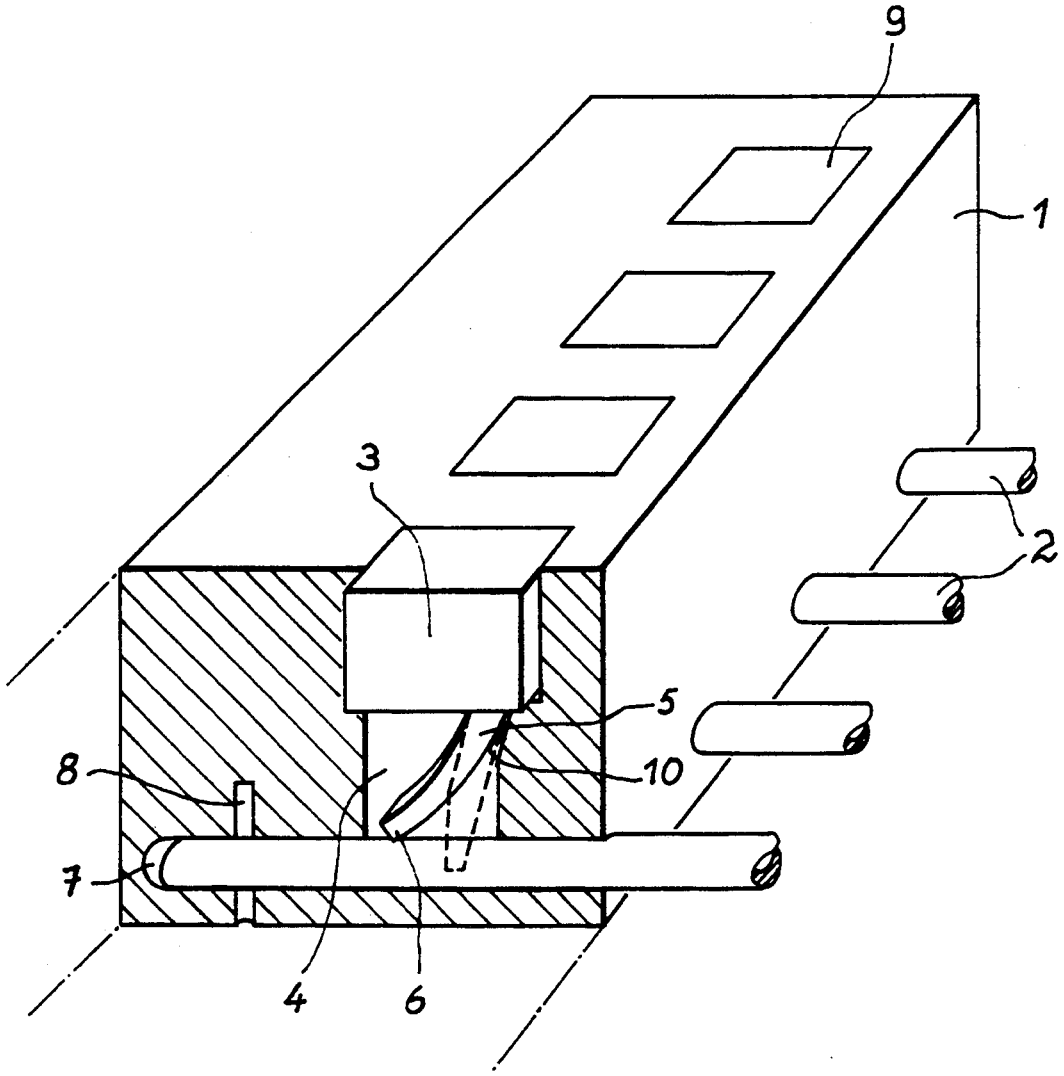

The process and apparatus are described simultaneously in the description. The apparatus shown in FIG. 1 illustrates the concept of the process according to the invention. As standardized cable termination means it mainly comprises a block 1, which can be made from a plastics material and within which is inserted for each electric wire to be installed, a locking means. Thus, the principle of the apparatus according to the invention consists more particularly of keeping fixed the free end 10 of a wire 2 in a part, or a panel permitting a simple, fast subsequent connection without having to recognize or manipulate the wire 2 in question.

To this end, the locking means can be constituted by a locking part 3 which can be inserted in a cavity 9 of the block 1. This locking part 3 has a flexible tongue 5 placed in a locking portion 4 of the cavity 9 in order to ensure there the locking of the wire 2, by means of its end 6. The locking part 3 is preferably made from a plastics material.

As is made clear by the two positions of the tongue 5 in FIG. 1, locking takes place as a result of the flexibility of said tongue 5. Thus, the wire 2 is introduced into a recess 7, which passes through the end of the locking portion 4 of the cavity 9 and preferably tangentially thereto. The diameter of the recess 7 exceeds the external diameter of the wire 2 and can accept several wire types having different conducting sections and different external diameters. As is shown by the broken line representation, the length of the tongue 5 makes it possible to penetrate by its end 6 the interior of the recess 7 within the locking portion 4. In this way, when the locking part 3 is introduced into the cavity 9, the end of the tongue is located in the volume of the recess 7. Thus, on introducing a wire 2 into the recess 7, the latter tends to raise the tongue 5 (thick line representation), because the latter is flexible and slightly rearwardly oriented in the introduction direction of the wire 2, i.e. is slightly inclined from the side opposite to the opening of the recess 7.

Bearing in mind the friction coefficients between the end 6 of the tongue 5 and the wire 2, this has the effect of attempting to extract the wire from the recess 7, so that the end 6 of the tongue 5 penetrates the wire 2. More specifically, the adhesion between the insulant covering the wire 2 and the end 6 of the tongue 5 forces the latter even further into the insulant of the wire 2. The tongue is curved inwards and comes into contact with an incline surface 10 of the cavity 9 positioned facing the base of the tongue 5. This incline surface 10 can facilitate the bracing of the tongue 5 against the wire 2 and reinforces the locking of the latter. Thus, the tongue 5 prevents the wire 2 from being extracted from the block 1 by locking it against a wall of the recess 7.

In FIG. 1, several cavities 9 are shown corresponding to the same number of wires 2, which can consequently be introduced and held by means of a single block 1. During the installation of the electrical infrastructure of a building, it is consequently possible to house the end of each of the wires of a cable issuing into a room in a single block 1. Therefore the wires 2 are maintained in a clearly defined location within a block provided for this purpose until the final connection thereof.

The final connection with the connectors of the equipments to be supplied takes place in preferred manner with the aid of a connecting hole 8 traversing the recess 7. The connecting hole 8 is preferably located towards the inner end of the recess 7. It is then merely necessary to introduce the wire 2 until it traverses the connecting hole 8 to ensure the future connection. This hole 8 is provided with an internal passage corresponding to the connecting element to be connected to the wires 2.

Thus, during the installation of these electric wires, it is very easy to slide each wire 2 into a recess 7 of a block 1 so that said wires 2 are maintained therein until their final connection. It is also possible to mark the identity of each of the wires and cables on the block 1.

Figure 2:
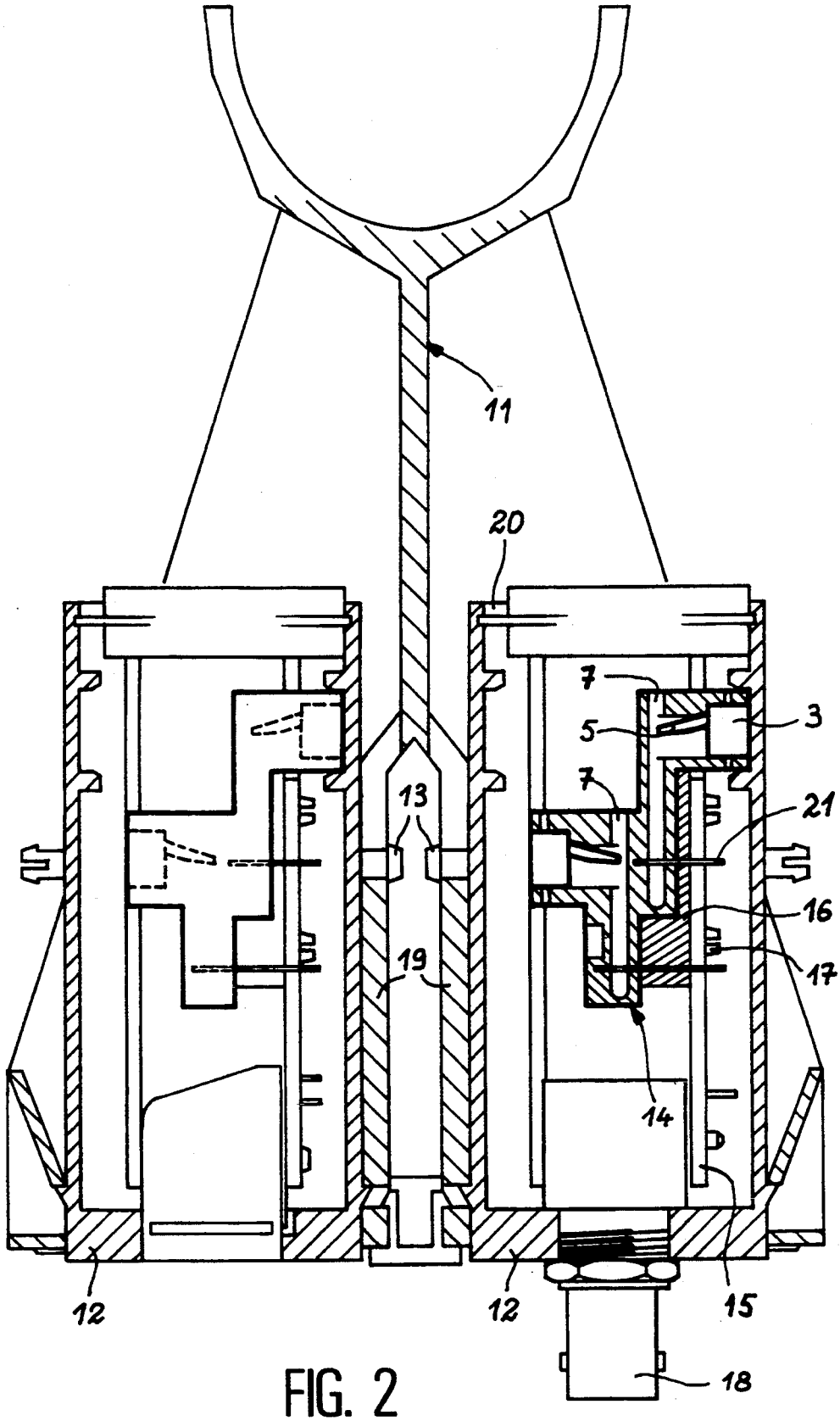

FIG. 2 shows an example of the use of the apparatus according to the invention with a standardized panel 11 for receiving a large number of supply cables to be connected with a large number of special or standardized connectors. The panel 11 can receive on its two facing walls 19 boxes 12 especially adapted for the connection to take place. The boxes 12 can be fixed to the panel 11 by means of split studs 13. In each of the said boxes 12 can be inserted one or more blocks 14, whose function is the same as that of the block 1 of FIG. 1, but which have a different shape. For example, the block 14 can receive two opposite series of locking parts 3. The recesses 7 of the block 14 issue towards the opening 20 of the box 12 in the embodiment shown. The connection of the wires takes place with a printed circuit 15 also located in the box 12. The block 14 is fixed to the printed circuit 15, preferably by means of an intermediate support 16 and by means of split studs 17.

Thus, it is possible to fix to the printed circuit 15 a large number of cables by means of a single block 14, prior to the connection of the printed circuit 15 to a subsequent apparatus. This connection can take place by means of a special socket 18 located at the end of the box 12. Several boxes 12 and in this case two such boxes can be placed on the same panel 11, as shown in FIG. 2.

The box 12 mechanically protects the complete connection assembly. It can be made from a preferably conductive plastics material in order to provide protection against electromagnetic waves or static electricity.

The electrical connection between the wires placed in the recesses 7 and the printed circuit 15 can be achieved with the aid of two contacts 21 to be bared or stripped placed in connecting holes 8 of FIG. 1 and in identical connecting holes in the printed circuit 15. Each box 12 can be detached from a panel 11 in order to be installed elsewhere, particularly on a base fixed to a wall, so as to form a wall socket or outlet.

Thus, once the cables are installed in the termination device according to the invention, any random user can carry out the final connection with the electric connecting wires without using special tools, as is usually the case. No matter what user can consequently install a large proportion of the sockets in the rooms to be fitted up.

The block can be made from a transparent plastics material in order to reveal the good positioning of all the wires. In general terms, the apparatus according to the invention can be installed very early during the cabling of the building on all the cables which will subsequently be required as the fitting up of the rooms takes place. It is then possible to remove one or more devices from a panel and change the position thereof. These operations take place without any risk of error, because the apparatus keeps the various wires in position, i.e. in the provided cabling order. This is ensured by the fact that once introduced into the block recesses, the wires cannot subsequently be removed therefrom. It is therefore not possible to interchange several wires.

The apparatus according to the invention is small. The length of the bared wires and cables is reduced to the minimum, said length being much less than the contact strips to be bared. As a result of its very design, the apparatus protects all the cables, even when they are very slightly bared. It is possible to use the apparatus according to the invention for electrical, telephone or data processing connections or links.

The described embodiment is obtained with the aid of a locking means in the form of a tongue, but other solutions can be envisaged. Reference is e.g. made to an anti-withdrawal cam, three strips mounted on an anti-withdrawal cone, as well as blocking rods or a retention cone.

We claim:

1. Apparatus for the termination of electric cables (2) installed in a building to be subsequently connected to various equipment to be supplied, comprising a block (1,14) having at least one cavity (9) traversed by a recess (7) for a wire (2), the recess (7) being traversed by a connecting hole (8) and at least one locking means housed in the cavity (9) and locking the corresponding cable (2) within the apparatus, characterized in that each locking means is produced in the form of a locking part (3) having a flexible, oblique clip (5) oriented towards the interior of the recess (7), whose end (6) leads into a connecting portion (4) of the cavity (3) occupied by the recess (7), so as to be able to exert a pressure on the wire (2) and maintain it in place, while preventing any withdrawal of said wire (2), further characterized in that it comprises a printed circuit (15) fixed to the block (14) by means of split studs (17), and in that it comprises an intermediate support (16) placed between the block (14) and the printed circuit (15).

2. Apparatus for the termination of electric cables (2) installed in a building and to be subsequently connected to various equipment to be supplied comprising a block (1, 14) having at least one cavity (9) traversed by a recess (7) for a wire (2), the recess (7) being traversed by a connecting hole (8) and at least one locking means housed in the cavity (9) and locking the corresponding cable (2) within the apparatus, characterized in that each locking means is produced in the form of a locking part (3) having a flexible, oblique clip (5) oriented towards the interior of the recess (7), whose end (6) leads into the connecting portion (4) of the cavity (3) occupied by the recess (7), so as to be able to exert a pressure on the wire (2) and maintain it in place, while preventing any withdrawal of said wire (2), and further characterized in that it comprises a block (12) within which can be inserted one or more assemblies constituted by a block (14) and one or more locking parts (3).

3. Apparatus according to claim 2, characterized in that it comprises a panel (11) able to receive at least one box (12), 4. Apparatus according to claim 2, characterized in that it comprises a base which can receive the box (12) transforming the latter into a wall socket.

* * * * *